US005620024A

United States Patent [19]

Yonezawa

[11] Patent Number: 5,620,024

[45] Date of Patent: Apr. 15, 1997

[54] RELIEF VALVE OPERATION DETECTOR

[75] Inventor: Keitaro Yonezawa, Kobe, Japan

[73] Assignee: Kabushiki Kaisha KOSMEK, Hyogo, Japan

[21] Appl. No.: 563,294

[22] Filed: Nov. 28, 1995

[30] Foreign Application Priority Data

Dec. 13, 1994 [JP] Japan ..... 6-308595

[51] Int. Cl.[6] ..... F16K 37/00

[52] U.S. Cl. ..... 137/554; 137/557

[58] Field of Search ..... 137/554, 557

[56] References Cited

U.S. PATENT DOCUMENTS

| | | | |
|---|---|---|---|
| 3,915,186 | 10/1975 | Thomas | 137/557 |
| 4,024,712 | 5/1977 | Takeuchi | 137/557 |
| 4,085,669 | 4/1978 | Yonezawa . | |
| 4,470,367 | 9/1984 | Bergeron | 137/557 |
| 5,218,994 | 6/1993 | Jeschke | 137/554 |
| 5,522,414 | 6/1996 | Reeves | 137/554 |

FOREIGN PATENT DOCUMENTS 42-14430 8/1942 Japan .

*Primary Examiner*—A. Michael Chambers
*Attorney, Agent, or Firm*—Bacon & Thomas

[57] ABSTRACT

An operation member (51) is fixedly secured to a right portion of a relief member (29) inserted into a housing (20). An annular transmission member (52) externally fitted to the operation member (51) is supported by a guide groove (62) so as to be vertically movable and is urged downward by a spring (74). When the relief member (29) doesn't perform the relief operation, a detected portion (65) of the transmission member (52) is made to access a detecting portion (68) of a proximity switch (14) by the operation member (51). At the time of the relief operation, the relief member (29) and the operation member (51) are rapidly moved rightward, so that the detected portion (65) is spaced apart from the detecting portion (68) by the spring (74).

8 Claims, 6 Drawing Sheets

11
20
20a
73
14
67
74
68
a
64
60
G
51(A)
53
52
62
58
59
61
55
65
(X)
29
b
51
(B)
(Y)
e
c
(C)
(Z)
f

RELIEF VALVE OPERATION DETECTOR

BACKGROUND OF THE INVENTION

1. Field of the Invention

The present invention relates to a relief valve for use in a hydraulic overload protector of a mechanical press, and more specifically to an equipment for detecting an operation condition of the relief valve.

2. Disclosure of Prior Art

One of such conventionally known relief valve operation detectors is disclosed in Japanese Patent Publication No. 42-14430.

In this prior art, an operation cam is fixedly secured to a relief member to be actuated for relief in its axial direction, and the operation cam is kept in direct contact with a roller of a limit switch of the roller and lever type. When the relief member performs the relief operation, the cam is moved in the axial direction to swing a swinging lever of the limit switch at a predetermined angle, so that the relief operation condition can be detected.

Now, recently, since both the remarkable increasing of an operation speed and downsizing of a processing machine such as a mechanical press progress simultaneously, an improvement of operation accuracy and a downsizing are strongly required also of a relief valve for use in the processing machine.

In order to improve the operation accuracy of the relief valve, it is necessary to decrease a valve opening lift of the relief member. That is, since a time needed for the relief member to move from its closed position to its fully opened position becomes shorter due to the decreasing of the valve opening lift, a differential between a pressure at the time of the relief starting and a pressure at the time of the entire relieving becomes smaller correspondingly thereto. Therefore, it is possible to set a so-called cracking pressure accurately.

Further, also in order to manufacture the relief valve compactly, it is necessary to decrease the valve opening lift of the relief member similarly as mentioned above. That is, since a movement distance of the relief member becomes shorter, a housing etc. can be manufactured smaller in size correspondingly thereto.

Incidentally, in the case of the relief valve of the spring valve closing type, since also a spring lift becomes smaller by the decreasing of the valve opening lift, a service life of the spring becomes elongated.

As mentioned above, in order to improve the operation accuracy of the relief valve, it is necessary to make the valve opening lift of the relief valve as small as possible. But, when the valve opening lift is made small in that way, the following problems appear in such a construction that the the swinging lever of the limit switch is operated by the operation cam fixedly secured to the relief member like in the above-mentioned prior art.

That is, as the valve opening lift of the relief member is made smaller, also the movement distance of the operation cam becomes shorter. Therefore, it becomes impossible to swing the swinging lever at a desired angle. As a result, it becomes impossible to detect the condition of relief operation of the relief valve.

In order to solve the above-mentioned problems of the prior art, the inventor of the present invention proposed a detector illustrated in FIG. 7 preparatory to the present invention. This earlier invention has the following construction.

relief member 129 is inserted into a housing 120 so as to be movable in the right and left directions, a support member 150 is threadably secured to a right end portion of the relief member 129, a detected portion 165 like a thin ring is formed in the support member 150, and a detecting portion 168 of a proximity switch 114 is made to face an outer peripheral surface of the detected portion 165. The illustrated condition shows a normal condition in which the relief member 129 doesn't perform the relief operation. At the time of the relief operation, the relief member 129 and the detected portion 165 firstly move to the right relief position by a distance (e) in maximum and then move to the left relief completion position by a distance (f) via the illustrated normal position. Incidentally, in this earlier invention, since the valve opening lift of the relief member 129 is set to as small a value as possible, right and left movement distances of the detected portion 165 take very small values such as (e)=4.5 mm and (f)=2.5 mm.

When such very small rightward and leftward movements of the detected portion 165 are detected by the proximity switch 114, it is necessary to reduce a width dimension (w) of the detected portion 165 [herein, (w)=1.2 mm] and to maintain a clearance (h) between the detected portion 165 and the detecting portion 168 in a predetermined value [herein, (h)=0.8 mm].

But, in order to control the value of the clearance (h) accurately, it is necessary to finish the housing 120, a supporting bracket 153 of the proximity switch 114, the support member 150, the detected portion 165 and so on especially accurately and to assemble them elaborately in consideration of the existence of fitting clearances between those component parts. As a result, a manufacturing cost of the relief valve increases enormously.

SUMMARY OF THE INVENTION

It is an object of the present invention to detect the condition of relief operation reliably and to enable efficient finishing and assembly of a relief valve, For accomplishing the above-mentioned object, a relief valve operation detector according to the present invention is constructed as follows, for example as shown in FIGS. 1 through 4, or FIG. 5 or 6.

A relief member 29 is inserted into a relief valve chamber 26 within a housing 20 operably to be opened and closed, and an operation member 51 is connected to the relief member 29. A transmission member 52 is disposed between the operation member 51 and a detecting means 14. The transmission member 52 is provided with an operated portion 64 to be engaged with the operation member 51 and a detected portion 65 facing a detecting portion 68 of the detecting means 14. The detected portion 65 is moved to at least two positions of a first position X spaced apart from an axis of motion G of the operation member 51 and a second position Y adjacent to the axis G thereof. The operated portion 64 is pushed toward the operation member 51 by an elastic means 74.

Incidentally, as the elastic means 74 may be used a spring, a rubber or the like. As the detecting means 14 may be used a proximity switch, a photoelectric switch, a reed switch, a limit switch or the like.

The present invention functions as follows, for example as shown mainly in FIG. 4.

In the normal condition in which the relief member 29 doesn't perform the relief operation, as shown in FIG. 4(*a*), the operation member 51 is held at a central position A and the detected portion 65 of the transmission member 52 is moved by the operation member 51 to the first position X spaced apart from the axis G of the operation member 51, so that the detected portion 65 accesses the detecting portion 68 of the detecting means 14. Thus, a condition of the detected portion 65 is detected by the detecting portion 68 and a normal condition of the relief member 29 can be judged from an output signal of the detecting portion 68.

Further, since the operated portion 64 of the transmission member 52 is pushed and brought into contact with the operation member 51 by an urging force of the elastic means 74, even when vibrations act on the relief valve 11, it is possible to prevent the rattling of the detected portion 65.

When the relief member 29 performs the relief operation, as shown in FIG. 4(*b*), the operation member 51 is rapidly moved to a right advanced position B. Following this, the detected portion 65 is moved to a second position Y adjacent to the axis G of the operation member 51 by the urging force of the elastic means 74 to be spaced apart from the detecting portion 68. By detecting the condition of the detected portion 65 by the detecting portion 68, the relief condition of the relief member 29 is judged by the output signal of the detecting portion 68.

The present invention has the following advantages.

At the time of the relief operation, by moving the transmission member so as to access or space apart from the axis of the operation member, it becomes possible to make the detected portion of the transmission member space apart from or access the detecting portion of the detecting means. Therefore, it becomes possible to make the detecting direction of the detecting means substantially coincide with the movement direction of the detected portion, so that a slight movement of the detected portion can be detected. Therefore, even when the valve opening lift of the relief member and the movement distance of the operation member are decreased, it is possible to detect the condition of relief operation reliably.

Further, as mentioned above, since the slight movement of the detected portion can be detected by the detecting means, it becomes unnecessary to accurately control a distance relationship between the detecting portion of the detecting means and the detected portion. Therefore, it becomes unnecessary to pay special attention to both finishing accuracies and assembling accuracies of the housing, the operation member, the transmission member, a support bracket of the detecting, means and so on in the relief valve. As a result, the relief valve can be finished and assembled efficiently, so that its manufacturing cost can be reduced.

These and still other objects and advantageous features of the present invention will become more apparent from the following description of the embodiments when taken in conjunction with the attached drawings.

BRIEF DESCRIPTION OF THE DRAWINGS

FIG. 1 is a detailed view of a portion indicated by an arrow I in FIG. 2;

FIG. 2 is a system view of an overload protector for a mechanical press employing a relief valve;

FIG. 3 is an enlarged view of a partial sectional view taken along the III—III line in FIG. 1.

FIG. 4 is an explanatory view about the operation of a detector arranged in the relief valve;

FIG. 4(*a*) shows a condition in which the relief operation is not performed;

FIG. 4(*b*) shows a maximum relief condition;

FIG. 4(*c*) shows a relief completion condition;

DESCRIPTION OF THE PREFERRED EMBODIMENTS

Figure 1:
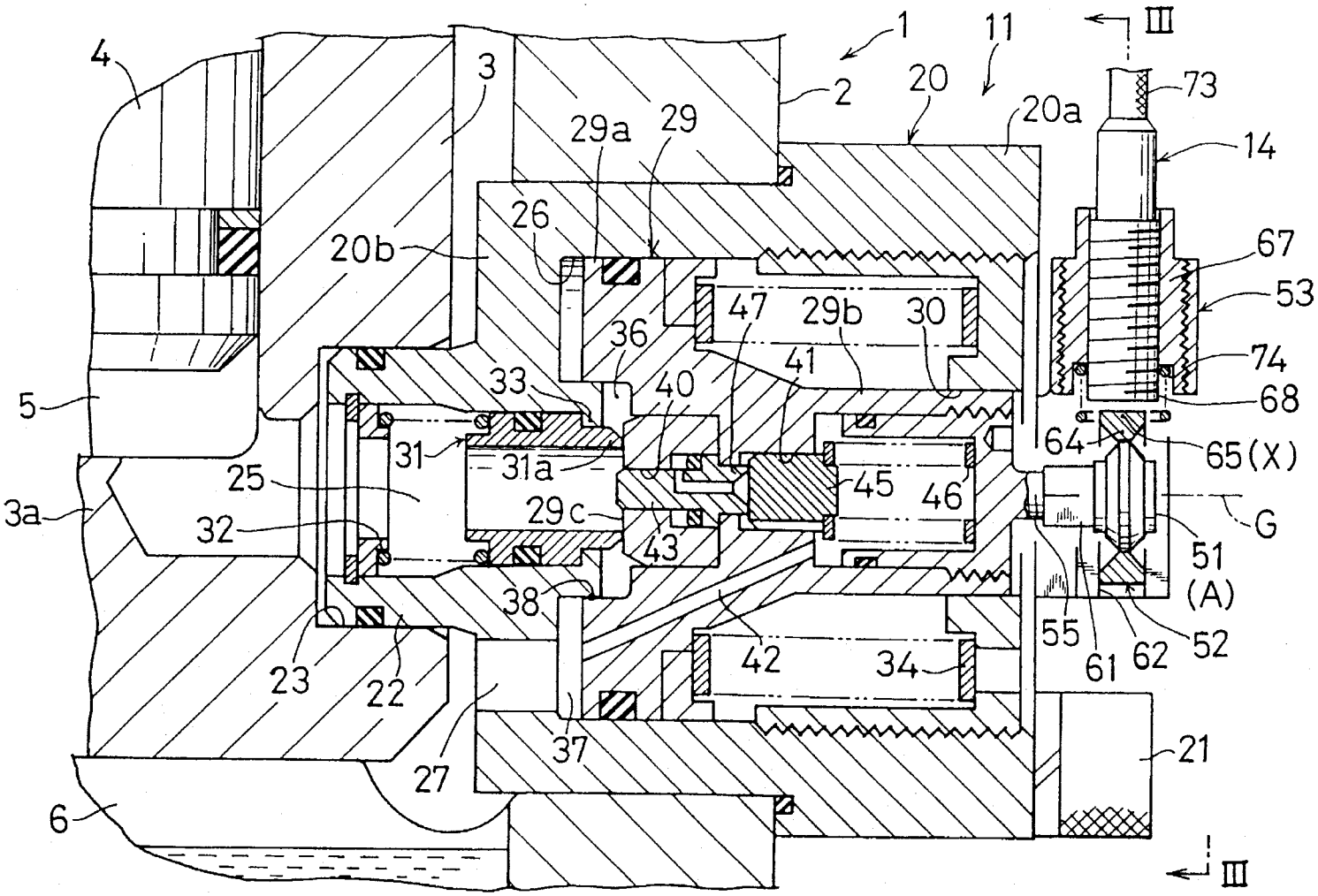
FIGS. 1 through 4 show one embodiment of the present invention.

FIGS. 1 through 4 exemplarily show a relief valve of the present invention which is applied to a hydraulic overload protector. First of all, a general construction of the overload protector will be explained with reference to FIG. 2 and FIG. 1.

A cylinder 3 is mounted to a slide 2 of a mechanical press 1, an overload absorbing cylinder chamber 5 is formed between a piston 4 inserted into the cylinder 3 and a bottom wall 3*a* of the cylinder 3, and an oil reservoir 6 is formed below the bottom wall 3a. An oil within the oil reservoir 6 is supplied into the cylinder chamber 5 at a predetermined pressure by a pneumatic hydraulic booster 7. During the press working of the mechanical press 1, a pressing force transmitted from a crankshaft 8 to the piston 4 through a connecting rod 9 is transmitted to a work material through the pressurized oil within the cylinder chamber 5.

During the press working, when a plurality of work materials are fed to the mechanical press 1 at a time by mistake or foreign objects happen to intrude between an upper and a lower metal molds, an overload might be imposed to the slide 2. Thereupon, a pressure of the pressurized oil within the cylinder chamber 5 is increased abnormally, and thus the high pressurized oil pushingly opens the relief valve 11 rapidly to be discharged into the oil reservoir 6. Thereby, a descending force of the piston 4 is not transmitted to the slide 2 and a protection operation is performed within a range of a stroke S of the piston 4.

A pressure compensating valve 12 is arranged in parallel to the relief valve 11. When the pressurized oil within the cylinder chamber 5 is increased at a very slow speed by a temperature rising during the press working, the compensating valve 12 discharges only a portion of the pressurized oil corresponding to that pressure increased portion into the oil reservoir 6. Thereby, it becomes possible to prevent the relief valve 11 from performing an erroneous overload operation and the pressure within the cylinder chamber 5 can be maintained within a predetermined range.

The press 1 is provided with a protection means for preventing the piston 4 from colliding with the bottom wall 3*a* of the cylinder 3 when an overload exceeding the range of the stroke S acts on the slide 2. That is by detecting the overload operation of the relief valve 11 by the detecting means 14, a main electric motor M is stopped and a clutch N is disengaged by an output signal of the detecting means 14 through a controller 15, or simultaneously with that, a braking force is applied to the crankshaft 8 or the like.

Figure 3:
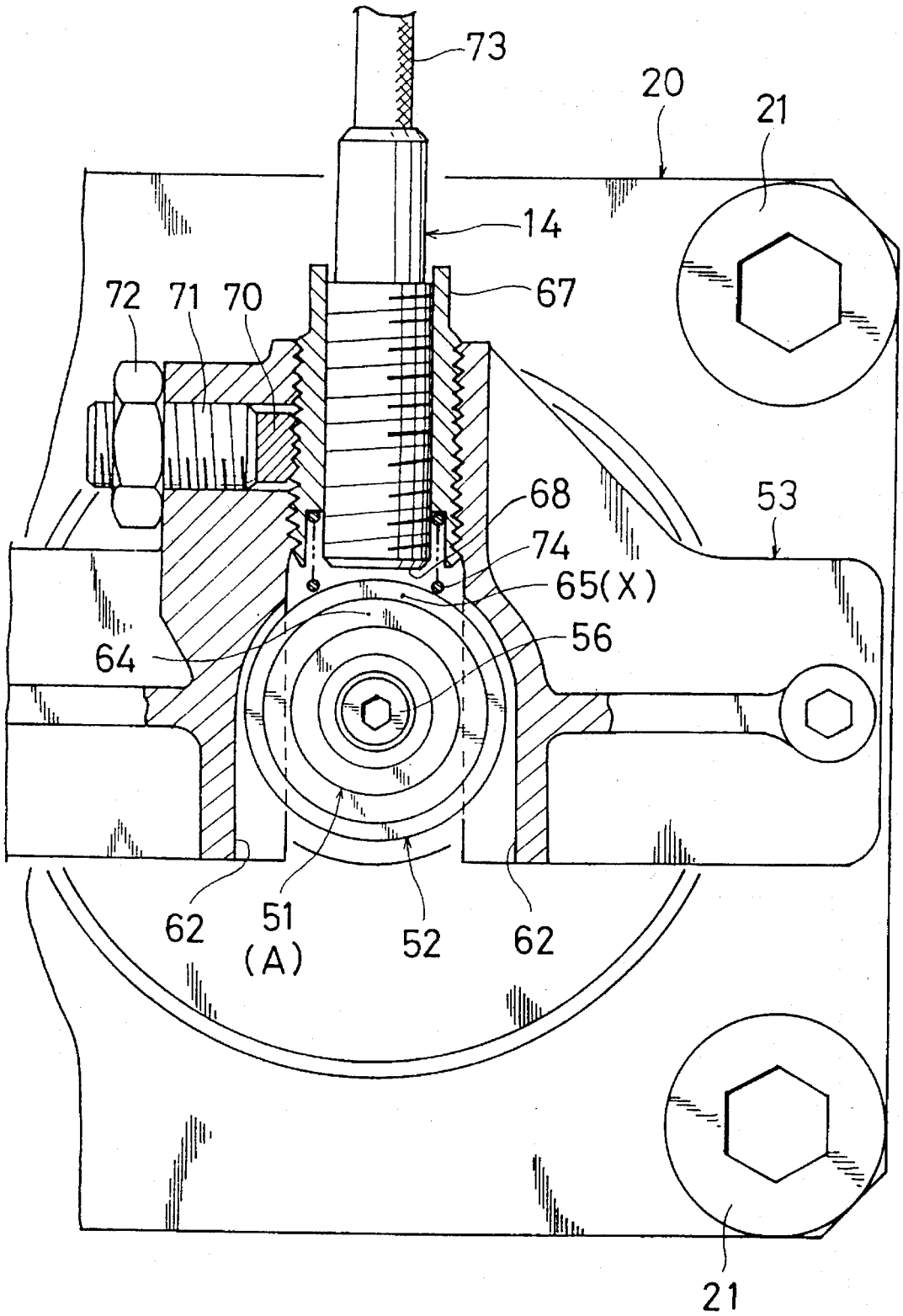
Figure 4:
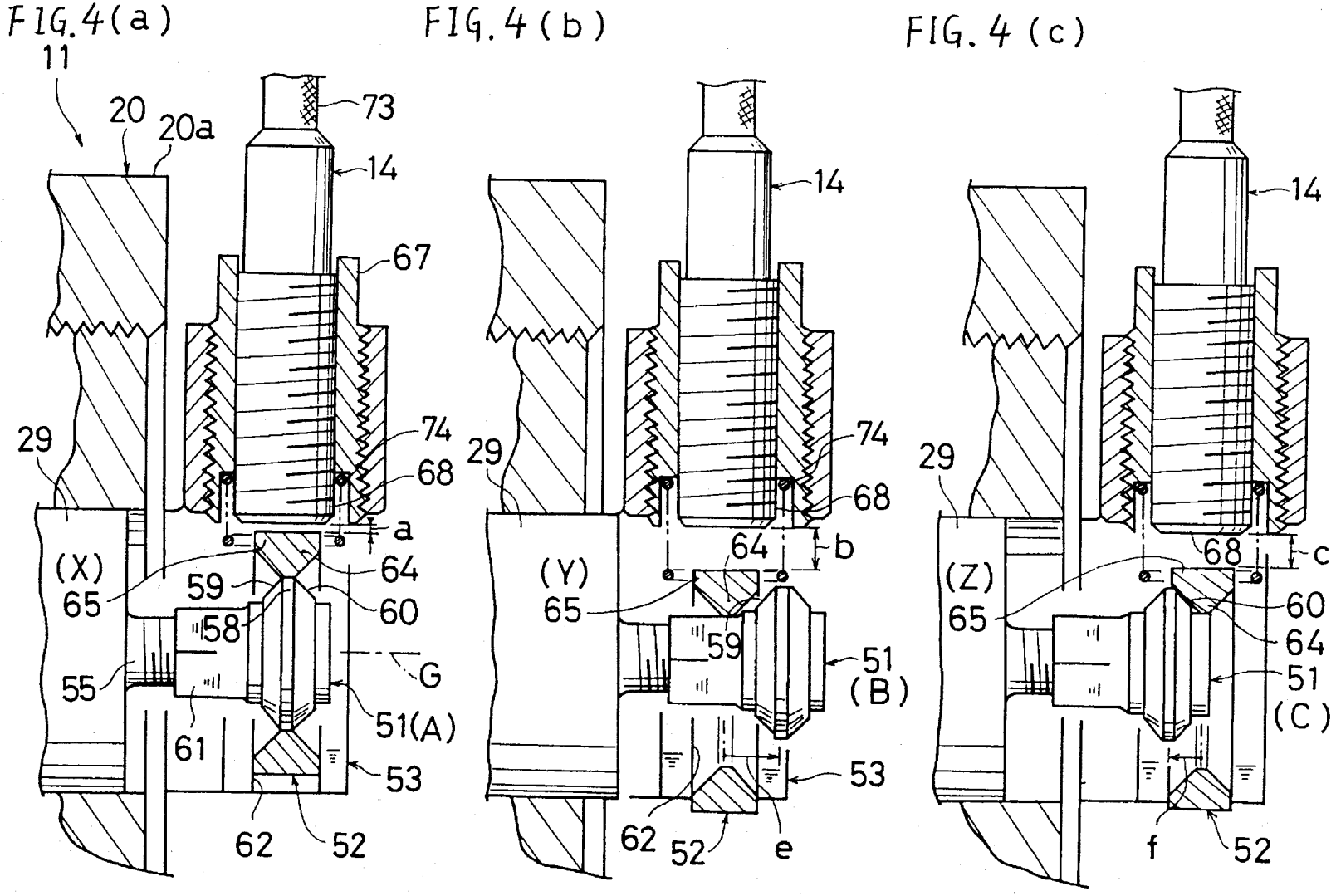

A concrete construction of the relief valve 11 will be explained with reference to FIGS. 1, 3 and 4(*a*). FIG. 3 is an enlarged view of a sectional view taken along the directed line III—III in FIG. 1. FIG. 4(*a*) is an enlarged view of a principal portion in FIG. 1.

A housing 20 of tile relief valve 11 is fixedly secured to tile slide 2 oil-tightly by a plurality of bolts 21, and a left end boss portion 22 of the housing 20 is fitted oil-tightly into a communication port 23 formed in the bottom wall 3*a* of the cylinder 3. Thereby, the overload absorbing cylinder chamber 5 is made communicable with the oil reservoir 6 through an inlet port 25 formed in the boss portion 22, a relief valve chamber 26 and a discharge port 27 in order.

A large diameter portion 29*a* of the relief member 29 is inserted into the relief valve chamber 26 so as to be oil-tightly movable in the axial direction, and a small diameter portion 29*b* of the relief member 29 is inserted into a guide port 30 formed in a right end wall (an outer end wall) 20*a* of the housing 20. A valve seat tube 31 inserted into the inlet port 25 is urged rightward by a valve closing spring 32, and the rightward movement of the valve seat tube 31 beyond a predetermined distance is prevented by a stopper wall 33. The relief member 29 is urged leftward by a relief spring 34 so that a valve surface 29*c* of that member 29 can be brought into contact with a relief valve seat 31*a* of the valve seat tube 31 for valve closing.

Within the relief valve chamber 26, a valve opening pressurizing chamber 36 is formed diametrally outside the relief valve seat 31*a* as well as an outlet chamber 37 is formed diametrally outside the pressurizing chamber 36, and a throttling passage 38 is formed between the pressurizing chamber 36 and the outlet chamber 37. The throttling passage 38 is constructed by an annular fitting gap between the stopper wall 33 and the relief member 29. Under the fully opened condition of the relief member 29, the pressurizing chamber 36 and the outlet chamber 37 are in direct communication with each other, and both these chambers 36, 37 are communicated with each other through the throttling passage 38 while the relief member 29 is closing.

The pressure compensating valve 12 is constructed as follows. A throttling valve chamber 40, a pressure compensating valve chamber 41 and an outlet port 42 are formed orderly in a central portion of the relief member 29. A throttling member 43 is inserted into the throttling valve chamber 40 so as to be slidable within a predetermined range, so that a throttling valve can be constructed by a slide clearance defined therebetween. A pressure compensating member 45 inserted into the pressure compensating valve chamber 41 is brought into contact with a pressure compensating valve seat 47 for valve closing by a pressure compensating spring 46. Thus, when the pressure within the cylinder chamber 5 increases abnormally at a very slow speed, an oil pressure acting on a pressure receiving surface of the pressure compensating member 45 makes that member 45 space apart from the valve seat 47 against the spring 46. Thereby, the pressurized oil within the cylinder chamber 5 is discharged little by little from the outlet port 42.

The relief valve 11 operates as follows.

During the press working, as shown in FIG. 1, since the relief member 29 is kept in contact with the relief valve seat 31*a* for valve closing by the relief spring 34, the pressure within the cylinder chamber 5 is maintained within the predetermined range.

When the oil pressure within the cylinder chamber 5 increases rapidly due to the overload acting on the slide 2, first the valve surface 29*c* of the relief member 29 is slightly spaced apart from the relief valve seat 31*a* by the oil pressure and then the oil pressure starts to act on the pressurizing chamber 36. Thereby, the relief member 29 is rapidly moved rightward for valve opening, so that the pressurized oil within the cylinder chamber 5 is discharged abundantly to the oil reservoir 6 through the inlet port 25, the pressurizing chamber 36, the outlet chamber 37 and the discharge port 27 in order.

When the pressure within the inlet port 25 decreases due to the relief operation the relief spring 34 starts to move the relief member 29 leftward. Thereupon, since a space between the pressurizing chamber 36 and the outlet chamber 37 starts to be throttled by the throttling passage 38 while the valve is closing the discharge amount of the pressurized oil is restricted so that the relief member 29 can move leftward slowly for valve closing. Thereby, the relief member 29 is first brought into contact with the relief valve seat 31*a* for valve closing, subsequently moved leftward pushing the valve seat tube 31 leftward and then received by the housing 20.

For detecting the operation condition of the relief valve 11 there is provided a detector.

As shown in FIGS. 1, 3 and 4(*a*), the detector includes an operation member 51 arranged on the right side of the right end wall 20*a* of the housing 20, an annular transmission member 52 externally fitted to the operation member 51 and the detecting means 14. The detecting means 14 comprises a proximity switch and is fixedly secured to the housing 20 through a bracket 53.

That is, a connecting male screw 55 is projected rightward from the small diameter portion 29*b* of the relief member 29 substantially coaxially with the axis of the relief member 29, and the operation member 51 is threadably engaged with the male screw 55 and fixedly secured thereto by a lock bolt 56 (refer to FIG. 3). The operation member 51 includes a convex cam portion 58, groove portions 59, 60 formed on the opposite left and right sides of the cam portion 58 and a wrench engagement hexagonal portion 61.

The annular transmission member 52 is supported by a guide groove 62 of the bracket 53 so as to be vertically movable. An operated portion 64 to be engaged with the operation member 51 is formed in an inner peripheral surface of the transmission member 52, and a detected portion 65 is constructed by an outer peripheral surface of the transmission member 52.

The proximity switch 14 is threadably engaged with a holder 67 and integrated with the holder 67 by adhesive. The holder 67 is threadably engaged with the bracket 53. Thereby, a detecting portion 68 provided in a lower portion of the proximity switch 14 is faced to the detected portion 65 of the transmission member 52 so as to be adjustable in height. Incidentally, in FIG. 3, the symbol 70 designates a detent piece, the symbol 71 does a set bolt, and the symbol 72 does a lock nut. The bending of an electrical cable 73 of the proximity switch 14 is prevented by a guard spring (not illustrated).

Further, a compression coil spring 74 is mounted between the holder 67 and the transmission member 52 so that the operated portion 64 of the transmission member 52 can be brought into contact with an upper portion of the peripheral surface of the cam portion 58 by the spring 74. Thereby, even when strong vibrations are imposed to the transmission member 52 during the press working, the rattling of the detected portion 65 can be prevented. Incidentally, according to this embodiment an urging force of the spring 74 is set to a value (about 250 gf) that is 50 times as heavy as a weight (about 5 gf) of the transmission member 52 therein, 1 gf is about 0.01N (Newton).

The detector operates as follows, as shown mainly in FIG. 4. FIG. 4(*a*) shows the same condition as that illustrated in FIG. 1 and shows a normal condition in which the relief member 29 of the relief valve 11 doesn't perform the relief operation. FIG. 4(*b*) shows a condition in which the relief member 29 performs the relief operation in maximum. FIG. 4(*c*) shows a condition in which the relief member 29 has completed the relief operation.

In the normal condition illustrated in FIG. 4(*a*), the operation member 51 is held at the illustrated central position A, and the transmission member 52 has been moved upward by the cam portion 58 of the operation member 51 against the compression coil spring 74. Following this, the detected portion 65 of the transmission member 52 has been raised to a first position X spaced apart from the axis of motion G of the operation member 51 to access the detecting portion 68 of the proximity switch 14. Thereby, the proximity switch 14 outputs the detection signal of the normal condition.

Figure 2:
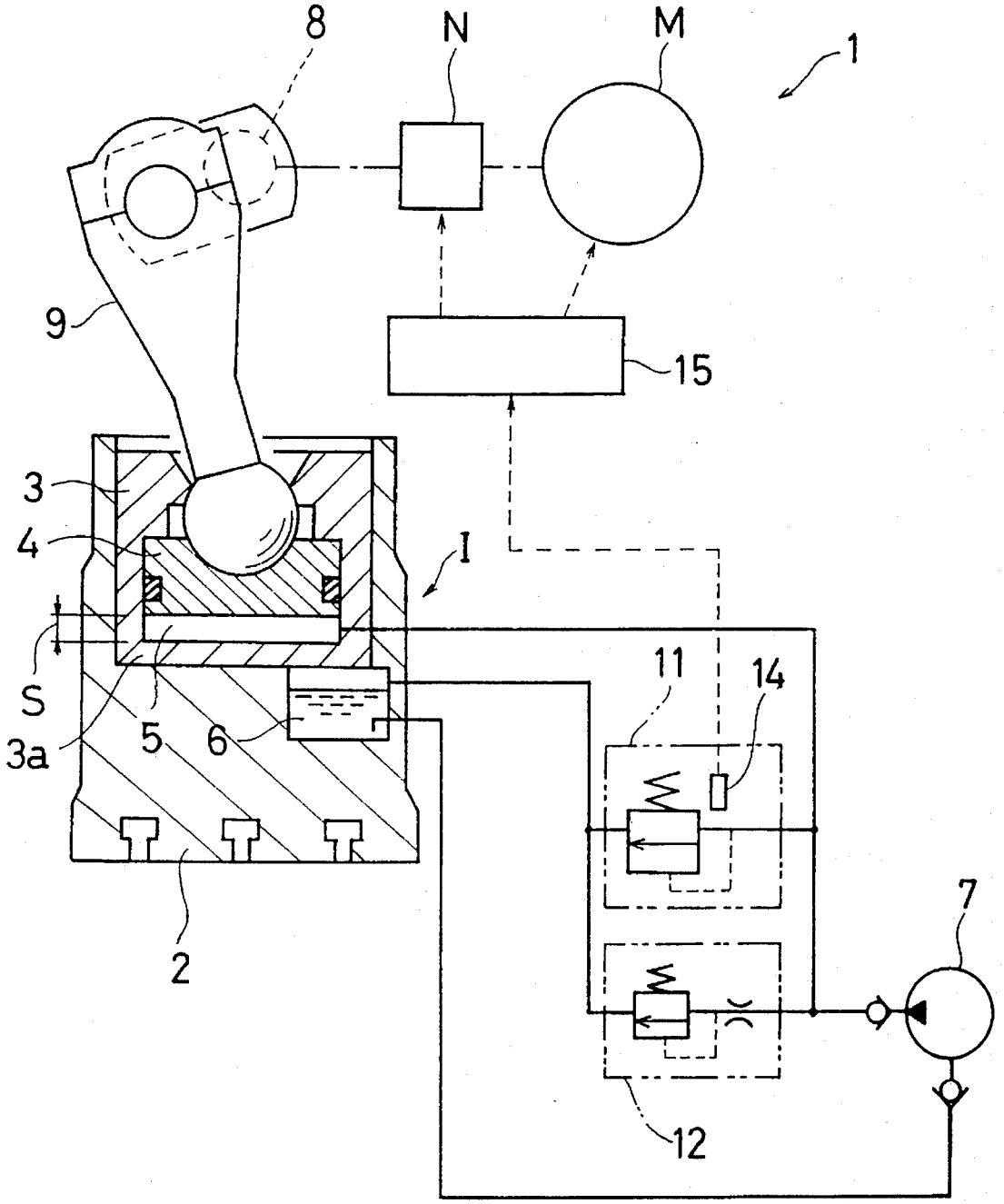

When the overload acts on the mechanical press and the relief member 29 performs the relief operation, as shown in FIG. 4(*b*), the operation manner 51 is moved rapidly to a right advanced position B by the distance (e). Following this, the transmission member 52 is moved downward by the spring 74, so that the operated portion 64 of the transmission member 52 is advanced to the left groove portion 59. Thereby, the detected portion 65 is lowered to a second position Y adjacent to the axis G of the operation member 51 to be spaced apart from the detecting portion 68. Thereby, the proximity switch 14 outputs the detection signal of the abnormal condition, and a control circuit of the controller 15 in FIG. 2 is self-held in the abnormality detection condition based on that output signal.

The relief member 29 is moved leftward as mentioned above after the relief operation illustrated in FIG. 4(*b*). Thereupon, the relief member 29 is changed over to the relief completion condition illustrated in FIG. 4(*c*) via the position illustrated in FIG. 4(*a*). Following this, since the operation member 51 is changed over to a retreated position C spaced apart leftward from the central position A by the distance (f), the operated portion 64 of the transmission member 52 is advanced to the right groove portion 60. Thereby, the detected portion 65 is lowered to a third position Z adjacent to the axis G of the operation member 51.

By the way, according to this embodiment, the distance (e) and the distance (f) take the same values as those of the above-mentioned earlier invention such as (e)=4.5 mm and (f)=2.5 mm respectively. In FIG. 4(*a*), a clearance (a) between the detected portion 65 at the first position X and the detecting portion 68 is about 0.8 mm, a clearance (b) between the detected portion 65 at the second position Y and the detecting portion 68 in FIG. 4(*b*) is about 2.8 mm, and also a clearance (c) therebetween in FIG. 4(*c*) is about 2.8 mm.

According to the above-mentioned embodiment, the following advantages can be obtained.

Figure 7:
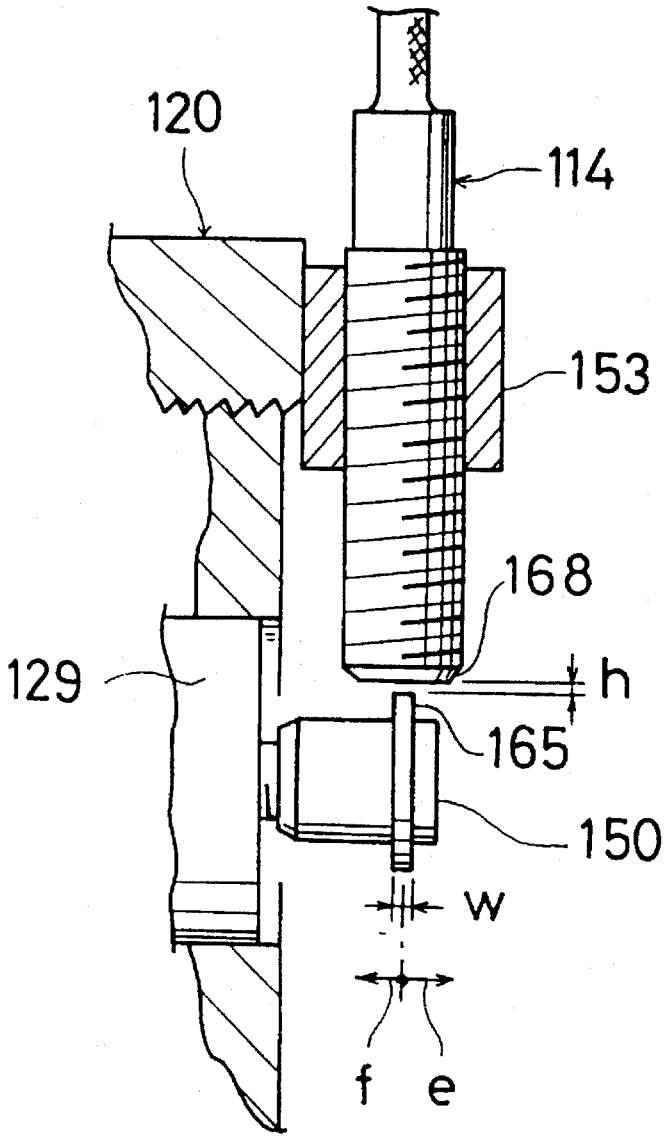
FIG. 7 shows a detector according to the earlier invention and is a view corresponding to FIG. 4(*a*).

Since the detected portion 65 of the transmission member 52 is moved far away from the detecting portion 68 of the proximity switch 14 at the time of relief operation of the relief valve 11 that moving condition can be detected reliably by the proximity switch 14 as well as can be confirmed also with the eye. Further, a width dimension of the detected portion 65 is different from a width dimension (w) of the detected portion 165 of the above-mentioned earlier invention (refer to FIG. 7) and can be set to a dimension suitable for a detecting performance of the detecting portion 68. Therefore, the movement of the detected portion 65 can be detected more reliably by the proximity switch 14.

Since the movement of the detected portion 65 can be detected reliably as mentioned above, it is unnecessary to strictly control the clearances (a) (b) (c) between the detected portion 65 and the detecting portion 68. Therefore, it becomes unnecessary to pay a special attention to both finishing accuracies and assembling accuracies of the housing 20, the operation member 51, the transmission member 52, the bracket 53 and so on.

Though strong vibrations act on the transmission member 52 during the press working of the mechanical press, since the operated portion 64 of the transmission member 52 can be held in contact with the operation member 51 by the spring 74, the rattling of the detected portion 65 which might be caused by the vibrations can be prevented. As a result, an erroneous operation of the detecting means 14 can be prevented.

Since the operation member 51, the transmission member 52 and the detecting means 14 are arranged outside the outer end wall 20*a* of the housing 20 of the relief valve 11, it becomes possible to make an inner end wall 20*b* of the housing 20 project into the slide 2 of the mechanical press 1. Therefore, a projection length of tile relief valve 11 from the slide 2 becomes shorter. As a result, the overload protector can be manufactured in compact even when the detector of the relief valve is provided.

Further, since the transmission member 52 is formed in the annular configuration and supported by the housing 20, it is possible to secure a large guide area between the guide groove 62 of the housing 20 and the transmission member 52. Therefore, it is possible to prevent an erroneous operation of the detecting means 14 by the improvement of the guide accuracy of the transmission member 52.

Since tile detecting means 14 comprises the proximity switch, the detecting portion 68 of the detecting means 14 and the detected portion 65 of the transmission member 52 can be kept in the noncontact state. Therefore, even when the transmission member 52 is operated rapidly by the relief member 29, an impact is not imposed to the detecting portion 68 to elongate the service life of the detecting means 14. Additionally, since the proximity switch 14 as the detecting means has contacts which need not be mechanically opened and closed differently from a limit switch and the like, its durability is superior and it is preferable for use in the relief valve of which component members operate rapidly to tend to be subjected to impacts.

Figure 5:
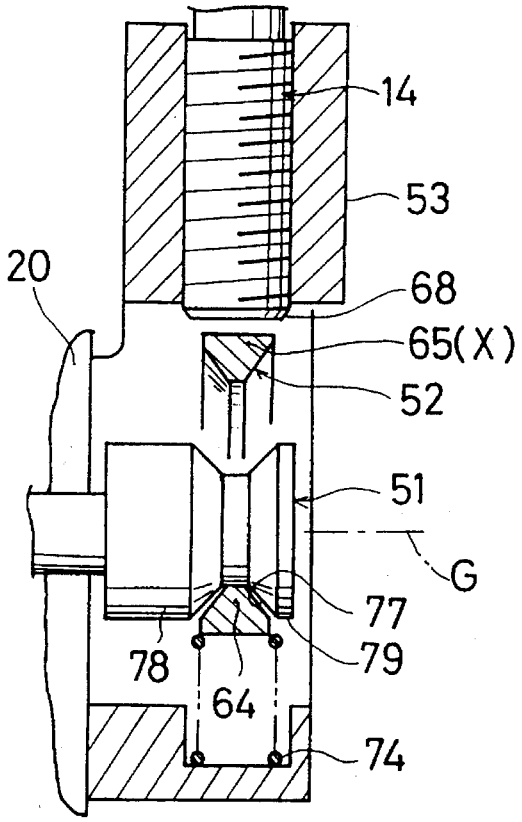
FIG. 5 shows a first variant example of the detector and is a view corresponding to FIG. 4(*a*)
Figure 6:
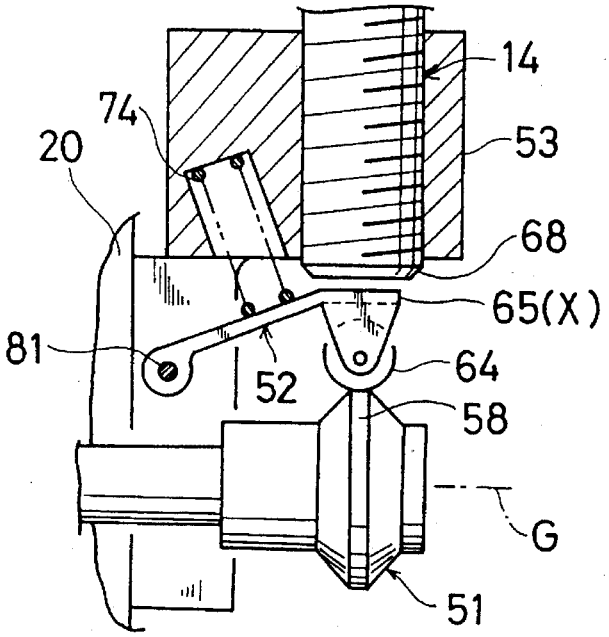
FIG. 6 shows a second variant example of the detector and is a view corresponding to FIG. 4(*a*)

FIG. 5 and FIG. 6 show a first variant example and a second variant example respectively and are views corresponding to FIG. 4(*a*). In the respective variant examples, the component members having the same constructions as those in the above-mentioned embodiment will be explained by designating them the same symbols in principle.

The first variant example illustrated in FIG. 5 is constructed as follows.

The operation member 51 includes a concaved groove portion 77 and right and left cam portions 78, 79 arranged on the opposite sides of the groove portion 77. The transmission member 52 is formed in the annular configuration similarly to the above-mentioned embodiment and supported by the bracket 53 so as to be vertically movable. Under the illustrated normal condition, the operated portion 64 of the transmission member 52 is brought into contact with the concaved groove portion 77 by an upward force of the compression coil spring 74.

The second variant example illustrated in FIG. 6 is constructed as follows.

The operation member 51 is constructed similarly to that of the above-mentioned embodiment. The transmission member 52 formed like a lever is supported by the bracket 53 through a pin 81 so as to be vertically swingable. The operated portion 64 comprising a roller is supported by a leading end portion of the transmission member 52, and the detected portion 65 is arranged in the leading end portion. The operated portion 64 is brought into contact with the cam portion 58 of the operation member 51 by the compression coil spring 74.

Incidentally, the operated portion 64 may comprise a cam fixedly secured to the transmission member 52 instead of the illustrated roller.

The above-mentioned embodiment and variant examples may be further modified as follows.

The elastic means for urging the transmission member 52 may comprise a tension spring or also a rubber and the like instead of the compression coil spring 74.

The detecting means for the detected portion 65 may comprise a photoelectric switch, a reed switch, a limit switch or the like instead of the proximity switch 14. When the detecting means comprises the limit switch, the roller and lever type, the plunger type or the like may be employed.

The connecting construction between the operation member 51 and the relief member 29 is not limited to the stationary constructions in the above-mentioned embodiment and variant examples but may be such a construction connected by a pin or the like. The operation member 51 may be such a one connected to an arm projecting diametrally outward from the relief member 29.

The relief valve may be of the type closing the valve by a gas pressure such as an air pressure instead of the spring closing valve type.

As many different embodiments of the invention will be obvious to those skilled in the art, some of which have been disclosed or referred to herein, it is to be understood that the specific embodiments of the invention as presented herein are intended to be by way of illustration only and are not limiting on the invention, and it is to be understood that such embodiments, changes or modifications may be made without departing from the spirit and scope of the invention as set forth in the claims appended hereto.

What is claimed is:

1. A relief valve operation detector comprising:

a housing (20) having a relief valve chamber (26);

a relief valve member (29) inserted into the relief valve chamber (26), said relief valve member moveable between opened and closed positions;

an operation member (51) having an axis of motion (G) and being always connected to the relief valve member (29) for movement therewith;

a transmission member (52) having an operated portion (64) to be engaged with the operation member (51) and a detected portion (65), the detected portion (65) being moveable between at least two positions including a first position (X) spaced apart from the axis (G) of the operation member (51) by a first distance and a second position (Y) spaced more closely adjacent to the axis (G) thereof by a second distance;

an elastic means (74) for urging the operated portion (64) into engagement with the operation member (51);

a detecting means (14) having a detecting portion (68) facing the detected portion (65); and said transmission member (52) arranged to be moved between said first position (X) and said second position (Y) upon movement of said operation member (51) along the axis of motion (G) in response to corresponding motion of said relief valve member (29);

whereby said movement of the transmission member (52) is detectable by said detecting means (14) to detect the motion of the relief valve member (29).

2. A relief valve operation detector as set forth in claim 1, wherein an overload absorbing cylinder chamber (5) and an oil reservoir (6) are arranged in a slide (2) of a mechanical press (1); said housing (20) having an end wall (20*a*) that is fixedly secured to the slide (2); said relief valve member (29) within the housing (20) being openable to discharge pressurized oil within the cylinder chamber (5) to the oil reservoir (6) when the pressurized oil exceeds a predetermined pressure; said operation member (51) being disposed outside the end wall (20*a*) of the housing (20); and said transmission member (52) and the detecting means (14) being disposed adjacent the operation member (51) outside the end wall.

3. A relief valve operation detector as set forth in claim 2, wherein the transmission member (52) is formed in an annular configuration; the annular transmission member (52) being supported by the housing (20) so as to be movable in a direction substantially perpendicular to the axis of motion (G) of the operation member (51); said operated portion (64) being disposed at an inner peripheral surface of the transmission member (52); and said detected portion (65) being disposed at an outer peripheral surface of the transmission member (52).

4. A relief valve operation detector as set forth in claim 2, wherein the detecting means (14) comprises a proximity switch.

5. A relief valve operation detector as set forth in claim 1, wherein the transmission member (52) formed in an annular configuration; the annular transmission member (52) being supported by the housing (20) so as to be movable in a direction substantially perpendicular to the axis of motion (G) of the operation member (51); said operated portion (64) being disposed at an inner peripheral surface of the transmission member (52); and said detected portion (65) being disposed at an outer peripheral surface of the transmission member (52).

6. A relief valve operation detector as set forth in claim 2, wherein the detecting means (14) comprises a proximity switch.

7. A relief valve operation detector as set forth in claim 1, wherein the detecting means (14) comprises a proximity switch.

8. A relief valve operation detector as set forth in claim 1, wherein said operation member (51) is fixedly attached to said relief valve member (29).

* * * * *